United States Patent [19]

Otomura

[11] Patent Number: 4,740,441

[45] Date of Patent: Apr. 26, 1988

[54] ELECTROPHOTOGRAPHIC PHOTOCONDUCTOR HAVING AN NI, FE, OR, CO-BASED ALLOY MATERIAL AS THE ELECTROCONDUCTIVE LAYER

[75] Inventor: Satoshi Otomura, Chiba, Japan

[73] Assignee: Ricoh Company, Ltd., Tokyo, Japan

[21] Appl. No.: 910,982

[22] Filed: Sep. 24, 1986

[30] Foreign Application Priority Data

Sep. 25, 1985 [JP] Japan ..... 60-210088

[51] Int. Cl.[4] ..... G03G 5/02

[52] U.S. Cl. ..... 430/63

[58] Field of Search ..... 428/409, 420; 430/69

[56] References Cited

U.S. PATENT DOCUMENTS 4,109,052 8/1978 Anderson ..... 428/409

4,444,859 4/1984 Mimura ..... 430/54

*Primary Examiner*—John L. Goodrow

*Attorney, Agent, or Firm*—Oblon, Fisher, Spivak, McClelland & Maier

[57] ABSTRACT

An electrophotographic photoconductor is disclosed which comprises a substantially transparent substrate, an electroconductive layer formed thereon, comprising an alloy selected from the group consisting of a Ni-based heat resistant alloy, a Fe-based heat resistant alloy and a Co-based heat resistant alloy, and a photoconductive layer formed on the electroconductive layer.

2 Claims, 1 Drawing Sheet

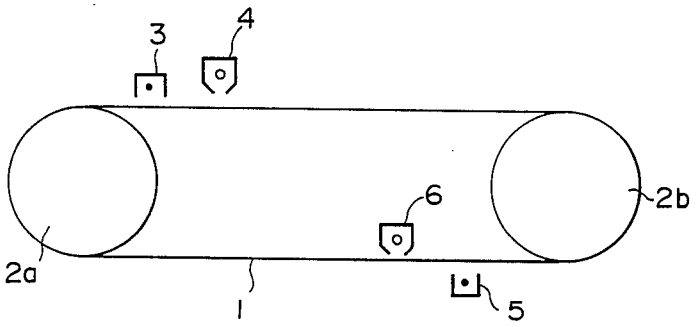
3
4
6
2b
2a
1
5

ELECTROPHOTOGRAPHIC PHOTOCONDUCTOR HAVING AN NI, FE, OR, CO-BASED ALLOY MATERIAL AS THE ELECTROCONDUCTIVE LAYER

BACKGROUND OF THE INVENTION

The present invention relates to an improved electrophotographic photoconductor comprising a substantially transparent substrate, an electroconductive metal layer formed thereon and a photoconductive layer formed on the electroconductive metal layer.

Electrophotographic photoconductors of the type comprising a substrate made of, for example, a plastic film, an electroconductive metal layer formed thereon by vacuum evaporation or sputtering of an electroconductive metal, and a photoconductive layer formed on the electroconductive metal layer are widely used at present.

As such plastic film, a polyethylene terephthalate film (hereinafter referred to as "PET film") is most widely used because it is advantageous in strength, durability, smoothness and dimensional stability over other plastic film materials.

As the material for the electroconductive layer, aluminum is usually employed. A PET film coated with aluminum is mass-produced and commercially available.

The reasons why aluminum is most widely used as the material for the electroconductive layer of the conventional electrophotographic photoconductors are that (1) a thin film of aluminum can be formed on a plastic film relatively without difficulty, (2) non-ohmic contact is easily attained at the interface of an electroconductive layer made of aluminum and a photoconductive layer formed thereon, (3) when an electroconductive layer made of aluminum is employed, an electrophotographic photoconductor which is excellent in the fundamental electrophotographic properties, such as charge acceptance, charge retention, dark decay, photosensitivity and residual potential, can be obtained, and (4) aluminum itself is an inexpensive material.

As a metal other than aluminum with which a PET film is coated, Ni can be used. In addition to this, Ti, Cr, Co and W can also be employed. These metals, however, are inferior to aluminum in the charge acceptance and charge retention, when used in the electrophotographic photoconductor. Furthermore, these metals have the shortcoming that the durability is poor. With respect to the durability, aluminum also has the same shortcoming as will be explained in detail later.

As the materials for the photoconductive layer, a variety of materials are employed. The main component of the photoconductive layer is a photoelectrically active semiconductor. Representative examples of such material are inorganic materials such as selenium, selenium alloys, CdS and ZnO and organic polymers and organic pigments such as polyvinylcarbazole and phthalocyanine.

As the substrate for the photoconductive layer, an electroconductive plastic film, for instance, an aluminum-coated PET film, is in general use. In addition to this, a Ni-coated plastic film and Ti-coated plastic film can also be employed. When the aluminum-coated PET film is used as the substrate, an organic photoconductor made of an organic photoconductive material is used in the photoconductive layer. This is because this combination is most suitable for mass production, inexpensive and excellent in the electrophotographic properties as compared with other combinations of substrate and photoconductive layer. Further, when the above combination is used, the electrophotographic photoconductor can be formed into a sheet. This provides great freedom in designing electrophotographic copying machine.

One of the best organic electrophotographic photoconductors available at present is of the so-called function-separation type, which comprises a substrate, an electroconductive layer formed on the substrate, a charge generating layer formed on the electroconductive layer, comprising as the main component an organic pigment, and a charge transporting layer formed on the charge generating layer, comprising as the main component an organic dye serving as charge transporting material which is dispersed in a resin.

In the electrophotographic photoconductor of the above type, a positive hole transporting material is mostly used as the charge transporting material. Therefore, the above electrophotographic photoconductor is used with application of a negative charge thereto. In this electrophotographic photoconductor, aluminum, nickel or titanium is employed in the electroconductive layer. Therefore, it is unavoidable that these metals are subjected to anodic oxidation while in use, with repeated negative charging and exposure to light for formation of latent electrostatic images. More specifically, when the surface of the photoconductive layer is charged to a negative polarity, a positive charge is induced on the back side thereof on the side of the electroconductive layer. When the photoconductive layer is exposed to a light image and corresponding latent electrostatic image is formed thereon, the electric charges at the surface of the photoconductive layer dissipate through the electroconductive layer. When this is repeated over and over again, the electroconductive layer is gradually subjected to anodic oxidation. Eventually, the electroconductive layer is oxided so that the resistivity thereof highly increases, losing the function as the electroconductive layer. In particular, when the substrate is transparent and charge quenching for image transfer and cleaning is performed by exposing the photoconductive layer to light from the side of the substrate, the electroconductive layer is designed so as to be significantly thin for easy quenching. In this case, the above-mentioned oxidation of the electroconductive layer occurs very quickly.

Even when the photosensitive layer is positively charged for the formation of latent electrostatic image, the photosensitive layer is charged negatively for quenching the positive charge in order to facilitate image transfer to a transfer sheet or to clean the surface of the photoconductive layer. The above problem is unavoidable in both negative charging and positive charging.

Noble metals such as Au, Pt and Pd are of course resistant to oxidation. However, when these noble metals are employed in the electroconductive layer, a sufficiently high charge acceptance for use in practice is not obtained in the photoconductive layer and the charge retention of the photoconductive layer somehow significantly decreases during repeated use of the photoconductor. Further, these metals are too expensive to use in the electroconductive layer. Therefore, these noble metals are not suitable for use in the electroconductive layer. Ni and Ti not only have similar shortcomings to the above-mentioned shortcomings of the noble metals, but also are gradually oxidized while in repeated use.

In order to avoid the above problem, it has been proposed to interpose an intermediate layer between the electroconductive layer and the photoconductive layer. However, this is not effective for preventing the anodic oxidation of the electroconductive layer. Rather, by use of such an intermediate layer, more problems take place with respect to the performance of the electrophotographic photoconductor, with the photosensitivity being decreased and the residual potential remaining high.

SUMMARY OF THE INVENTION

It is therefore an object of the present invention to provide an improved electrophotographic photoconductor from which the above described conventional problems are eliminated, with minimized oxidation of the electroconductive layer, and having particularly high durability and stability in electrophotographic performance.

In order to achieve the above object, an electrophotographic photoconductor according to the present invention comprises a substantially transparent substrate, an electroconductive layer formed thereon, comprising an alloy selected from the group consisting of a Ni-based heat resistant alloy, a Fe-based heat resistant alloy and a Co-based heat resistant alloy, and a photoconductive layer formed on the electroconductive layer.

BRIEF DESCRIPTION OF THE DRAWING

The single FIGURE is a schematic illustration of a test machine for testing the properties of an electrophotographic photoconductor.

DETAILED DESCRIPTION OF THE PREFERRED EMBODIMENTS

The Ni-based heat resistant alloy, the Fe-based heat resistant alloy and the Co-based heat resistant alloy for use in the present invention have the following respective formulations:

The Ni-based heat resistant alloy comprises 37 to 75 wt. % of Ni and 6 to 32 wt. % of at least one element selected from the group consisting of Cr, Co, Mo, Fe and Cu.

The Fe-based heat resistant alloy comprises 43 to 63 wt. % of Fe and 11 to 39 wt. % of at least one element selected from the group consisting of Ni and Cr.

The Co-based heat resistant alloy comprises 30 to 76 wt. % of Co and 21 to 33 wt. % of at least one element selected from the group consisting of Ni and Cr.

The above heat resistant alloys are not only resistant to heat, but also resistant to oxidation (including electrochemical oxidation) and corrosion.

Tables 1 through 3 show commercially available heat resistant alloys which belong to the above category and can be used in the present invention. These alloys are so highly stable that they are used, for instance, in chemical equipment, electronics equipment, jet engine and extruding die.

TABLE 1-(1)

| No. | Alloys | C | Si | Mn | Ni | Cr | Co | Mo | W | Nb | Ti | Al | Fe | Cu | B | Others |
|---|---|---|---|---|---|---|---|---|---|---|---|---|---|---|---|---|
| 1-1 | Hastelloy B | <0.05 | <1.0 | <1.0 | * | <1.0 | <2.5 | 28.0 | — | — | — | — | 5.0 | — | — | V 0.3 |
| 1-2 | Hastelloy B-2 | <0.02 | <0.1 | <1.0 | * | <1.0 | <1.0 | <28.0 | — | — | — | — | 2.0 | — | — | |
| 1-3 | Hastelloy C | <0.08 | <1.0 | <1.0 | * | 15.5 | <2.5 | 16.0 | 4.0 | — | — | — | 5.0 | — | — | V< 0.35 |
| 1-4 | Hastelloy C-4 | 0.015 | <0.08 | <1.0 | * | 16.0 | <2.0 | 15.5 | — | — | <0.7 | — | <3.0 | — | — | |
| 1-5 | Hastelloy C-276 | <0.02 | <0.08 | <1.0 | * | 16.0 | <2.5 | 16.0 | 4.0 | — | — | — | 5.0 | — | — | V< 0.35 |
| 1-6 | Hastelloy G | <0.05 | <1.0 | <1.5 | * | 22.0 | <2.5 | 6.5 | <1.0 | — | — | — | 19.5 | 2.0 | — | Nb + Ta 2.1 |
| 1-7 | Hastelloy G-3 | <0.015 | <0.4 | <1.0 | * | 22.0 | <5.0 | 7.0 | 1.0 | — | — | — | 19.5 | 1.9 | — | |
| 1-8 | Hastelloy X | <0.1 | <1.0 | <1.0 | * | 22.0 | 1.5 | 9.0 | 0.7 | — | — | — | 18.5 | — | — | |
| 1-9 | Hastelloy W | <0.12 | <1.0 | <1.0 | * | 5.0 | <2.5 | 24.5 | — | — | — | — | 5.5 | — | — | |
| 1-10 | Inconel X | 0.05 | 0.4 | 0.5 | * | 15.0 | — | — | — | 0.9 | 2.5 | 0.75 | 7.0 | 0.05 | — | |
| 1-11 | Inconel X550 | 0.04 | 0.3 | 0.7 | 72.5 | 15.0 | — | — | — | 1.0 | 2.5 | 1.20 | 7.0 | — | — | |
| 1-12 | Inconel X750 | 0.04 | 0.2 | 0.2 | * | 19.0 | — | 3.0 | — | 5.2 | 0.8 | 0.6 | 18.0 | 0.1 | — | |
| 1-13 | Inconel 600 | <0.15 | <0.5 | <1.0 | (+Co) >72.0 | — | + | — | — | — | — | — | 6.0~ 10.0 | <0.5 | — | |
| 1-14 | Inconel 700 | 0.16 | 0.25 | 0.1 | * | 15.0 | 28.0 | 3.0 | — | — | 2.2 | 3.0 | 0.07 | — | — | |
| 1-15 | Inconel 713c | 0.12 | <0.3 | <0.2 | * | 12.5 | — | 4.2 | — | 2.2 | 0.8 | 6.1 | <2.0 | — | 0.01 | Zr 0.10 |

(Ni-based Alloys)
Note:
The mark * denotes "Balance".

TABLE 1-(2)

| No. | Alloys | C | Si | Mn | Ni | Cr | Co | Mo | W | Nb | Ti | Al | Fe | Cu | B | Others |
|---|---|---|---|---|---|---|---|---|---|---|---|---|---|---|---|---|
| 1-16 | Udimet 500 | <0.1 | 0.75 | 0.75 | * | 17.5 | 16.5 | 4.0 | — | — | 3.0 | 3.0 | <3.0 | — | <0.01 | |
| 1-17 | Udimet 600 | <0.10 | — | — | * | 18.0 | 17.0 | 4.0 | — | — | 3.0 | 4.0 | — | — | 0.04 | |
| 1-18 | Udimet 700 | <0.1 | — | — | * | 15.0 | 18.5 | 5.0 | — | — | 3.5 | 4.3 | 1.0 | — | <0.10 | |
| 1-19 | Monel 400 | — | — | — | 66.5 | — | — | — | — | — | — | — | 1.2 | 31.5 | — | |

TABLE 1-(2)-continued

| No. | Alloys | C | Si | Mn | Ni | Cr | Co | Mo | W | Nb | Ti | Al | Fe | Cu | B | Others |
|---|---|---|---|---|---|---|---|---|---|---|---|---|---|---|---|---|
| 1-20 | Monel K-500 | — | — | — | 66.5 | — | — | — | — | — | 0.6 | 2.7 | 1.0 | 29.5 | — | |
| 1-21 | Illium G | — | — | — | 58.0 | 22.0 | — | 6 | — | — | — | — | 6 | 6 | — | |
| 1-22 | Illium R | — | — | — | 64.0 | 22.0 | — | 5 | — | — | — | — | 6 | 2.5 | — | |
| 1-23 | Incoloy 901 | 0.05 | 0.4 | 1.5 | 43.0 | 13.0 | — | 6.0 | — | — | 2.8 | 0.2 | * | — | 0.015 | |
| 1-24 | Nimonic 90A | 0.05 | 0.5 | 0.7 | * | 20.0 | 1.0 | — | — | — | 2.3 | 1.2 | 4.0 | — | — | |
| 1-25 | Nimonic 90 | 0.08 | 0.4 | 0.5 | * | 20.0 | 18.0 | — | — | — | 2.4 | 1.4 | 5.0 | — | — | |
| 1-26 | Nimonic 95 | 0.08 | 0.4 | 0.5 | * | 20.0 | 18.0 | — | — | — | 2.9 | 1.6 | 4.0 | — | — | |
| 1-27 | Nimonic 100 | 0.2 | 0.4 | — | * | 11.0 | 20.0 | 5.0 | — | — | 1.5 | 5.0 | 1.5 | — | — | |
| 1-28 | Nimonic 105 | 0.2 | — | — | * | 15.0 | 20.0 | 5.0 | — | — | 1.2 | 4.5 | — | — | — | |
| 1-29 | Nimonic 115 | 0.1 | — | — | * | 15.0 | 15.0 | 3.5 | — | — | 4.0 | 5.0 | — | — | 0.02 | Zr 0.05 |

(Ni-based Alloys)
Note:
The mark * denotes "Balance".

TABLE 2

| No. | Alloys | C | Si | Mn | Ni | Cr | Co | Mo | W | Nb | Ti | Al | Fe | Cu | B | Others |
|---|---|---|---|---|---|---|---|---|---|---|---|---|---|---|---|---|
| 2-1 | Incoloy 800 | 0.04 | — | — | 32.5 | 21.0 | — | — | — | — | — | — | 46.0 | — | — | |
| 2-2 | Incoloy 800H | 0.08 | — | — | 32.5 | 21.0 | — | — | — | — | — | — | 46.0 | — | — | |
| 2-3 | Incoloy 80Z | 0.4 | — | — | 32.5 | 21.0 | — | — | — | — | — | — | 46.0 | — | — | |
| 2-4 | Haynes Alloy No. 589 | 3.0 | — | — | | 17.0 | — | 16.0 | — | — | — | — | * | 2.2 | — | |
| 2-5 | Discaloy | 0.04 | 0.8 | 0.9 | 26.0 | 13.5 | — | 2.75 | — | — | 1.75 | 0.07 | * | — | — | |
| 2-6 | Carpenter No. 20 | — | — | — | 29.0 | 20.0 | — | 2.5 | — | — | — | — | * | 4.0 | — | |
| 2-7 | Carpenter No. 20.20Cb | — | — | — | 29.0 | 20.0 | — | 2.5 | — | — | — | — | * | 4.0 | — | Nb + Ta 0.9 |
| 2-8 | Unitempt 212 | 0.08 | 0.15 | 0.05 | 25.0 | 16.0 | — | — | — | 0.5 | 4.0 | 0.15 | * | — | 0.006 | Zr 0.05 |
| 2-9 | Refractaloy 26 | 0.03 | 1.0 | 0.08 | 38.0 | 18.0 | 20.0 | 3.2 | — | — | 2.6 | 0.2 | * | — | — | |
| 2-10 | Worthite | — | 3.5 | — | 24.0 | 20.0 | — | 3.0 | — | — | — | — | * | 2.0 | — | |
| 2-11 | DS Alloy 286 | <0.08 | <1.0 | <1.5 | 26.0 | 13.5 | <1.0 | 2.75 | — | — | 1.75 | <0.35 | * | 0.5 | 0.006 | |
| 2-12 | DS Alloy 6N | 0.13 | 0.5 | 0.6 | 12.0 | 19.0 | — | — | 3.25 | + | — | — | * | 0.5 | — | N 0.15<br>Nb + Ta 0.15 |

(Fe-based Alloys)
Note:
The mark * denotes "Balance".

TABLE 3

| No. | Alloys | C | Si | Mn | Ni | Cr | Co | Mo | W | Nb | Ti | Al | Fe | Cu | B | Others |
|---|---|---|---|---|---|---|---|---|---|---|---|---|---|---|---|---|
| 3-1 | Haynes Alloy No. 6B | 1.0 | — | — | 10.0 | 30.0 | * | — | 4.5 | — | — | — | 3.0 | — | — | |
| 3-2 | Haynes Alloy No. 25 | 0.1 | <1.0 | 1.5 | 10.0 | 20.0 | * | <1.0 | 15.0 | — | — | — | <3.0 | — | — | |
| 3-3 | Haynes Alloy No. 188 | 0.1 | — | 1.25 | 22.0 | 22.0 | * | — | 14.5 | — | — | — | <3.0 | — | 0.015 | La 0.09 |
| 3-4 | Haynes Stellite No. 1 | 2.5 | 1.0 | — | — | 30.0 | * | — | 12.0 | — | >3.0 | — | <3.0 | — | — | |
| 3-5 | Haynes Stellite No. 4 | >1.0 | >1.5 | — | — | 30.0 | * | >1.5 | 14.0 | — | >3.0 | — | — | — | — | |
| 3-6 | Haynes Stellite No. 6 | 1.1 | 1.0 | — | >3.0 | 28.0 | * | — | 4.0 | — | — | — | >3.0 | — | — | |
| 3-7 | Haynes Stellite No. 12 | 1.4 | 1.4 | — | >3.0 | 29.0 | * | — | 8.0 | — | — | — | >3.0 | — | — | |
| 3-8 | Haynes Stellite No. 32 | 1.8 | — | — | — | 26.0 | (+Ni) * | — | 12.0 | — | — | — | — | — | — | |
| 3-9 | Haynes Stellite No. 711 | 2.7 | — | — | + | 27.0 | * | + | + | — | — | — | 23.0 | — | — | W + Mo 10.0 |
| 3-10 | Haynes Stellite No. 1016 | 2.5 | — | — | >2.5 | 32.0 | * | — | 17.0 | — | — | — | — | — | — | |
| 3-11 | Vitallium | 0.25 | 1.0 | 1.0 | 3.0 | 27.0 | * | 5.5 | — | — | — | — | 2.0 | — | 0.007 | |
| 3-12 | Nivco | 0.02 | 0.15 | 0.35 | 22.5 | — | * | — | — | — | 1.8 | 0.22 | 0.3 | — | — | Zr 1.10 |

(Co-based Alloys)
Note:
The mark * denotes "Balance".

The present invention will now be explained in detail with reference to the following examples according to the present invention.

EXAMPLE 1

An electrocondutive layer consisting of a Ni-alloy No. 1-1 shown in Table 1-(1) was formed by sputtering on a polyester film having a thickness of 75 μm in such a manner that the mean light transmittance ratio thereof in the visible light range was about 30%.

A charge generating layer consisting of 2.5 parts by weight of a bisazo pigment having the following formula (I) and 1 part by weight of a butyral resin in which the bisazo pigment was dispersed was formed with a thickness of 0.3 μm by blade coating on the above electroconductive layer.

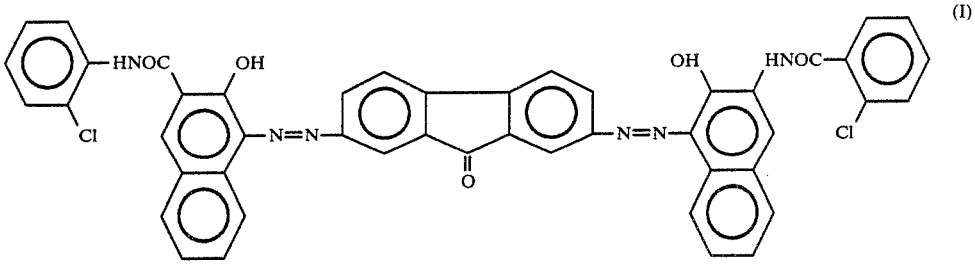

(I)

Finally, a charge transporting layer consisting of 9 parts by weight of a styryl compound having the following formula (II) and 10 parts by weight of a polycarbonate resin in which the styryl compound was dispersed was formed with a thickness of 20 μm by blade coating on the above charge generating layer, whereby an electrophotographic photoconductor No. 1 according to the present invention was prepared.

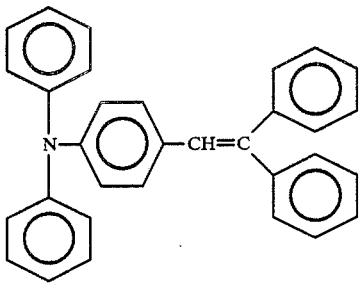

(II)

The electrophotographic properties of the electrophotographic photoconductor No. 1 were measured by Paper Analyzer (made by Kawaguchi Electro Works) in a dynamic mode by subjecting the photoconductor to charging, dark decay and exposure to light under the conditions that the charging current was −24 μA, the exposure of the photoconductor to light was 4.5 lux, and the charging, the dark decay and the exposure were respectively performed for 20 seconds, 20 seconds and 30 seconds. The results are shown in Table 4.

The above prepared electrophotographic photoconductor No. 1 was formed into an endless belt and incorporated in a charging and exposing test machine as illustrated in the accompanying single drawing.

In the figure, reference numeral 1 indicates a photoconductor, reference numerals 2*a* and 2*b* each indicate a drive roller, reference numerals 3 and 5 each indicate a charger, and reference numerals 4 and 6 each indicate a lamp.

First, the charger 3 was adjusted so as to charge the photoconductor 1 to −800 V and the light quantity of the lamp 4 was set so as to decrease the potential of the charged photoconductor to -100 V. These conditions correspond to the conditions of first charging and light image exposure of a commercially available copying machine.

The charging condition of the charger 5 was set so as to apply a negative charge of $1.5\times10^{-9}$ coulomb/cm$^2$ per revolution of the photoconductor 1. The light quantity of the lamp 6 was set so as to be 2.5 times the light quantity of the lamp 3. These conditions correspond to the conditions of image transfer and charge quenching exposure of the commercially available copying machine.

Under the above conditions, copy making was repeated 200,000 times and the electrophotographic properties of the photoconductor were measured under the same conditions as in the initial measurement. The results are shown in Table 4, which indicate that the changes in the electrophotographic properties were very slight and there was no substantial deterioration after the above copying test.

EXAMPLE 2

Example 1 was repeated except that Alloy No. 1-1 employed in Example 1 was replaced by Alloy No. 1-10 shown in Table 1-(1), whereby an electrophotographic photoconductor No. 2 according to the present invention was prepared.

The thus prepared electrophotographic photoconductor No. 2 was evaluated in the same manner as in Example 1. The result was that the initial electrophotographic properties and the durability were almost the same as those of obtained in Example 1.

EXAMPLE 3

Example 1 was repeated except that Alloy No. 1-1 employed in Example 1 was replaced by Alloy No. 1-24 shown in Table 1-(2), whereby an electrophotographic photoconductor No. 3 according to the present invention was prepared.

The thus prepared electrophotographic photoconductor No. 2 was evaluated in the same manner as in Example 1. The result was that the initial electrophotographic properties and the durability were almost the same as those obtained in Example 1.

EXAMPLE 4

Example 1 was repeated except that Alloy No. 1-1 employed in Example 1 was replaced by Alloy No. 1-16 shown in Table 1-(2), whereby an electrophotographic photoconductor No. 4 according to the present invention was prepared.

The thus prepared electrophotographic photoconductor No. 4 was evaluated in the same manner as in Example 1. The result was that the initial electrophotographic properties and the durability were almost the same as those obtained in Example 1.

EXAMPLE 5

Example 1 was repeated except that Alloy No. 1-1 employed in Example 1 was replaced by Alloy No. 2-1 shown in Table 2, whereby an electrophotographic photoconductor No. 5 according to the present invention was prepared.

The thus prepared electrophotographic photoconductor No. 5 was evaluated in the same manner as in Example 1. The result was that the initial electrophotographic properties and the durability were almost the same as those obtained in Example 1.

EXAMPLE 6

Example 1 was repeated except that Alloy No. 1-1 employed in Example 1 was replaced by Alloy No. 3-1 shown in Table 3, whereby an electrophotographic photoconductor No. 6 according to the present invention was prepared.

The thus prepared electrophotographic photoconductor No. 6 was evaluated in the same manner as in Example 1. The result was that the initial electrophotographic properties and the durability were almost the same as those obtained in Example 1.

COMPARATIVE EXAMPLE 1

Example 1 was repeated except that the electroconductive layer made of the nickel alloy was replaced by an electroconductive layer made of aluminum, whereby a comparative electrophotographic photoconductor No. 1 was prepared.

The thus prepared comparative electrophotographic photoconductor No. 1 was evaluated in the same manner as in Example 1. The result was that when the number of copies reached 60,000, the photosensitivity of the photoconductor was completely lost.

The electrophotographic properties of this comparative electrophotographic photoconductor before and after the copying test are shown in Table 4. The result indicates the fundamental properties of the photoconductor were completely impaired by the repeated charging and exposure in the making of 60,000 copies.

COMPARATIVE EXAMPLE 2

Example 1 was repeated except that the electroconductive layer made of the nickel alloy was replaced by an electroconductive layer made of titanium, whereby a comparative electrophotographic photoconductor No. 2 was prepared.

The electrophotographic properties of this comparative electrophotographic photoconductor before and after the copying test are shown in Table 4, which indicate that the entire electrophotographic properties were inferior to those of the electrophotographic photoconductors in Examples 1 through 6 according to the present invention.

COMPARATIVE EXAMPLE 3

Example 1 was repeated except that the electroconductive layer made of the nickel alloy was replaced by an electroconductive layer made of tungsten, whereby a comparative electrophotographic photoconductor No. 3 was prepared.

The electrophotographic properties of this comparative electrophotographic photoconductor before and after the copying test are shown in Table 4, which indicate that the entire electrophotographic properties were inferior to those of the electrophotographic photoconductors in Examples 1 through 6 according to the present invention.

TABLE 4

| | Alloys | $V_1$ | $V_{max}$ | DD | $E_{(\frac{1}{2})}$ | $V_R$ |
|---|---|---|---|---|---|---|
| Example 1 | No. 1-1 | 500 | 1200 | 0.84 | 1.14 | 0 |
| | | 450 | 1150 | 0.80 | 1.06 | 0 |

TABLE 4-continued

| | Alloys | $V_1$ | $V_{max}$ | DD | $E_{(\frac{1}{2})}$ | $V_R$ |
|---|---|---|---|---|---|---|
| Example 2 | No. 1-10 | 550 | 1250 | 0.85 | 1.15 | 0 |
| | | 480 | 1200 | 0.83 | 1.08 | 2 |
| Example 3 | No. 1-24 | 560 | 1320 | 0.87 | 1.16 | 0 |
| | | 500 | 1280 | 0.85 | 1.10 | 2 |
| Example 4 | No. 1-16 | 550 | 1280 | 0.85 | 1.15 | 0 |
| | | 500 | 1200 | 0.83 | 1.08 | 0 |
| Example 5 | No. 2-1 | 400 | 1100 | 0.80 | 1.05 | 0 |
| | | 380 | 1000 | 0.77 | 1.04 | 2 |
| Example 6 | No. 3-1 | 450 | 1200 | 0.83 | 1.08 | 0 |
| | | 400 | 1050 | 0.78 | 1.05 | 4 |
| Comparative | Al | 570 | 1500 | 0.91 | 1.20 | 0 |
| Example 1 | | 1350 | 1630 | 0.99 | * | — |
| Comparative | Ti | 370 | 1030 | 0.80 | 0.94 | 0 |
| Example 2 | | 240 | 870 | 0.60 | 1.50 | 230 |
| Comparative | W | 500 | 1000 | 0.80 | 1.02 | 0 |
| Example 3 | | 320 | 900 | 0.55 | 1.40 | 180 |
| Comparative | Ni | 550 | 1100 | 0.75 | 1.05 | 0 |
| Example 4 | | 320 | 850 | 0.85 | 1.20 | 130 |

Remarks:
(1) In the above table, * denotes that the measurement was impossible.
(2) In each example, the values in the upper row are the initial values and those in the lower row are the values after the making of 200,000 copies except for Comparative Example 1, the values for which were obtained after the making of 60,000 copies.
(3) $V_1$ denotes the potential of the photoconductor after the charging continued for 1 second.
(4) $V_{max}$ denotes the potential of the photoconductor after the charging continued for 20 seconds.
(5) DD denotes the decreasing ratio of the potential of the photoconductor after the dark decay continued for 20 seconds.
(6) $E_{(\frac{1}{2})}$ denotes the exposure (lux second) which requires to reduce the initial charge ($V_{max} \times$ DD) of the photoconductor to half.
(7) $V_R$ denotes the potential of the photoconductor after the exposure to light continued for 30 seconds.

Electrophotographic photoconductors are usually used at room temperature and atmospheric pressure. Therefore, it appears to be unnecessary to use as the material for the electroconductive layer materials which are highly resistant to heat and oxidaion. However, if the material for the electroconductive layer is not highly resistant to heat and oxidation and once the oxidation is initiated due to slight electric current flow, the oxidation gradually but surely proceeds. Eventually the electroconductive layer becomes an insulating layer due to the oxidation.

According to the present invention, however, the above problem can be avoided as can be seen from the results shown in Table 4.

What is claimed is:

1. An electrophotographic photoconductor comprising a substantially transparent substrate, an electroconductive layer formed thereon, comprising an alloy selected from the group consisting of a Ni-based heat resistant alloy, a Fe-based heat resistant alloy and a Co-based heat resistant alloy, and a photoconductive layer formed on said electroconductive layer, wherein said Ni-based heat resistant alloy comprises 37 to 75 wt. % of Ni and 6 to 32 wt. % of at least one element selected from the group consisting of Cr, Co, Mo, Fe and Cu, wherein said Fe-based heat resistant alloy comprises 43 to 63 wt. % of Fe and 11 to 39 wt. % of at least one element selected from the group consisting of Ni and Cr, and wherein said Co-based heat resistant alloy comprises 30 to 76 wt. % of Co and 21 to 33 wt. % of at least one element selected from the group consisting of Ni and Cr.

2. The electrophotographic photoconductor as claimed in claim 1, wherein said photoconductor layer comprises a charge generating layer and a charge transporting layer.

* * * * *